US011597417B2

(12) United States Patent
Mohns et al.

(10) Patent No.: US 11,597,417 B2
(45) Date of Patent: Mar. 7, 2023

(54) APPARATUS FOR USE WITH A RAISE CLIMBER IN A MINING CONSTRUCT HAVING AN ACCESS DRIFT AND MINING CONSTRUCT INCLUDING THE APPARATUS

(71) Applicant: Dumas Contracting Ltd., Toronto (CA)

(72) Inventors: Wayne Mohns, Toronto (CA); Anthony A. Linton, Toronto (CA); Andrew Smith, Toronto (CA)

(73) Assignee: Dumas Contracting Ltd.

( * ) Notice: Subject to any disclaimer, the term of this patent is extended or adjusted under 35 U.S.C. 154(b) by 525 days.

(21) Appl. No.: 16/778,869

(22) Filed: Jan. 31, 2020

(65) Prior Publication Data

US 2021/0016808 A1 Jan. 21, 2021

Related U.S. Application Data

(60) Provisional application No. 62/911,588, filed on Oct. 7, 2019, provisional application No. 62/874,132, filed on Jul. 15, 2019.

(51) Int. Cl.
*B61J 1/06* (2006.01)
*B61B 3/02* (2006.01)

(52) U.S. Cl.
CPC ..... *B61J 1/06* (2013.01); *B61B 3/02* (2013.01)

(58) Field of Classification Search
CPC ..... B61J 1/06; B61B 3/02; B66B 1/06; H02P 3/14; H02P 6/04; E21D 3/00; E21D 7/00; E21D 13/00; E21F 13/004; E21F 13/006; E21F 13/02; E21F 13/04; E21F 13/06; E21F 13/061; E21F 13/08
See application file for complete search history.

(56) References Cited

U.S. PATENT DOCUMENTS 4,917,018 A * 4/1990 Loomer ..... E01B 25/26 104/99
2009/0071364 A1* 3/2009 Grenon ..... E21F 13/04 104/96

* cited by examiner

*Primary Examiner* — Robert J McGarry, Jr.
(74) *Attorney, Agent, or Firm* — Taylor English Duma LLP

(57) ABSTRACT

A construct can include an access drift; a length of rail disposed in the access drift; a pair of raise climbers, each adapted to be supported by the rail; a turntable to which the rail is mounted, the turntable being adapted to support the rail, and a raise climber supported thereby, for movement about an axis; a nest disposed adjacent the turntable; and a plurality of rails, each extending from the turntable such that, when the turntable is operatively positioned, the rail of the turntable is aligned therewith, the plurality including at least a pair of curve rails and a nest rail, the curve rails each being adapted to develop a raise and the nest rail being positioned in the nest.

5 Claims, 12 Drawing Sheets

APPARATUS FOR USE WITH A RAISE CLIMBER IN A MINING CONSTRUCT HAVING AN ACCESS DRIFT AND MINING CONSTRUCT INCLUDING THE APPARATUS

REFERENCE TO RELATED APPLICATION

This application claims the benefit of U.S. Provisional Application No. 62/874,132, filed Jul. 15, 2019, and U.S. Provisional Application No. 62/911,588, filed Oct. 7, 2019, both of which are hereby specifically incorporated by reference herein in their entireties.

FIELD

The invention relates to the field of mining.

BACKGROUND

In the field of mining, it can be desirable to develop two raises A, B at different azimuths collaring from a similar heading, the raises being at a similar elevation to one another and each at an acute horizontal angle to an access drift C, as indicated in FIG. 1.

A conventional method to do so involves the use of pair of raise climbers (not shown) and a pair of nests D in an excavation E that is relatively large in both plan and elevation, as shown in FIG. 2A and FIG. 2B.

SUMMARY

Forming one aspect of the invention is a construct comprising: an access drift; a length of rail disposed in the access drift; a pair of raise climbers, each adapted to be supported by the rail; a turntable to which the rail is mounted, the turntable being adapted to support the rail, and any one of the raise climbers supported thereby, for movement about an axis; a nest disposed adjacent the turntable; and a plurality of rails, each rail of the plurality extending from the turntable such that, when the turntable is operatively positioned, the rail of the turntable is aligned therewith, the plurality of rails including at least a pair of curve rails and a nest rail, the curve rails each being adapted to develop a raise and the nest rail being positioned in the nest.

According to another aspect of the invention, the pair of curve rails can be adapted to develop two raises at different azimuths collaring from the same heading.

According to another aspect of the invention, the pair of curve rails can be adapted to develop two raises at different azimuths collaring from the same heading, at the same elevation and at an acute horizontal angle to the access drift.

According to another aspect of the invention, each raise climber can be a double drive raise climber.

Forming another aspect of the invention is apparatus for use with a raise climber and in a mining construct having an access drift. This apparatus comprises: a rail adapted to support the raise climber; and a turntable adapted to support the rail and the raise climber for movement about an axis.

Advantages, features and characteristics of the invention will become evident upon reviewing of the following detailed description with reference to the appended drawings, the latter being briefly described hereinafter.

DETAILED DESCRIPTION

Figure 1:
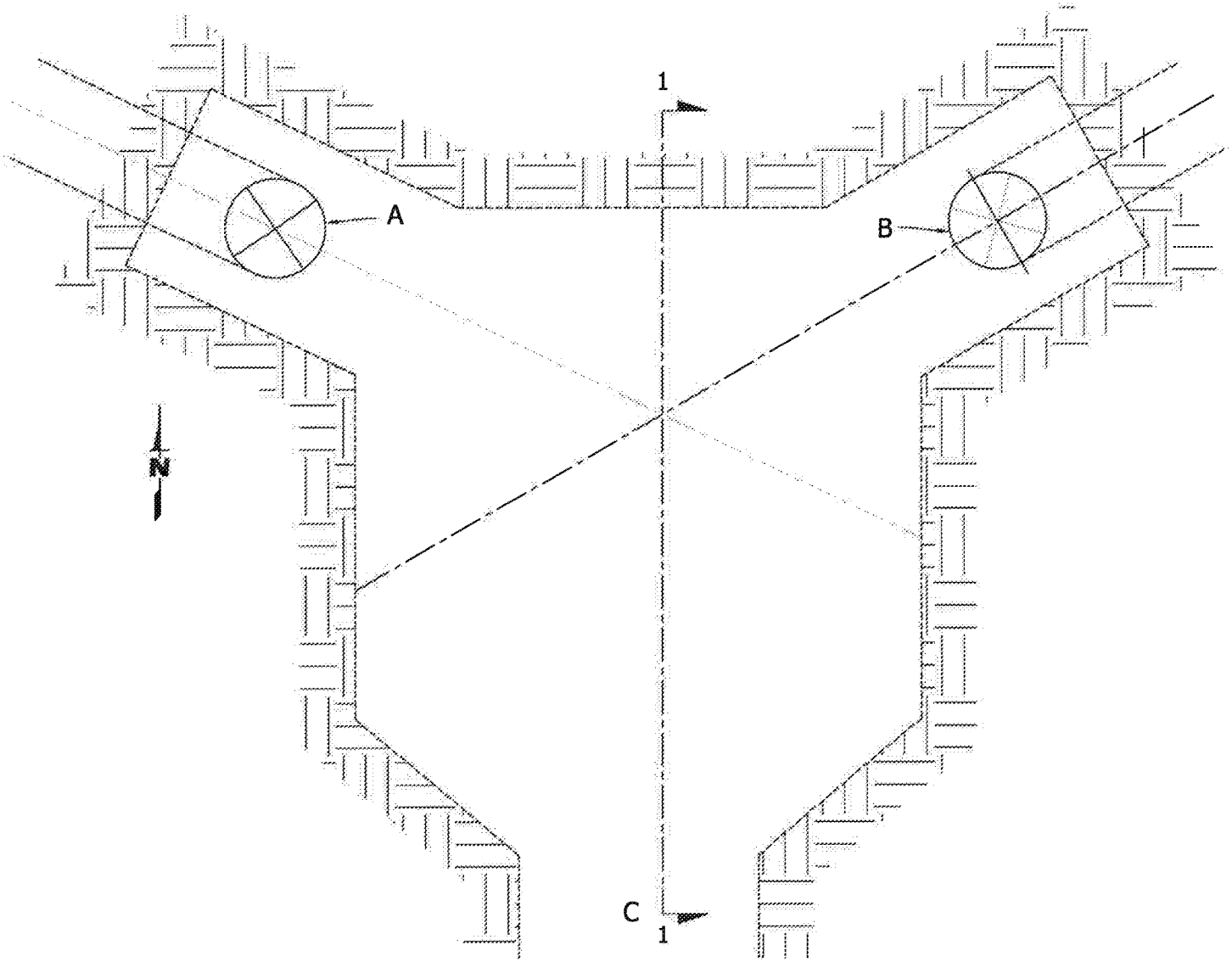
FIG. 1 is a plan view of a desired construct.
Figure 2A:
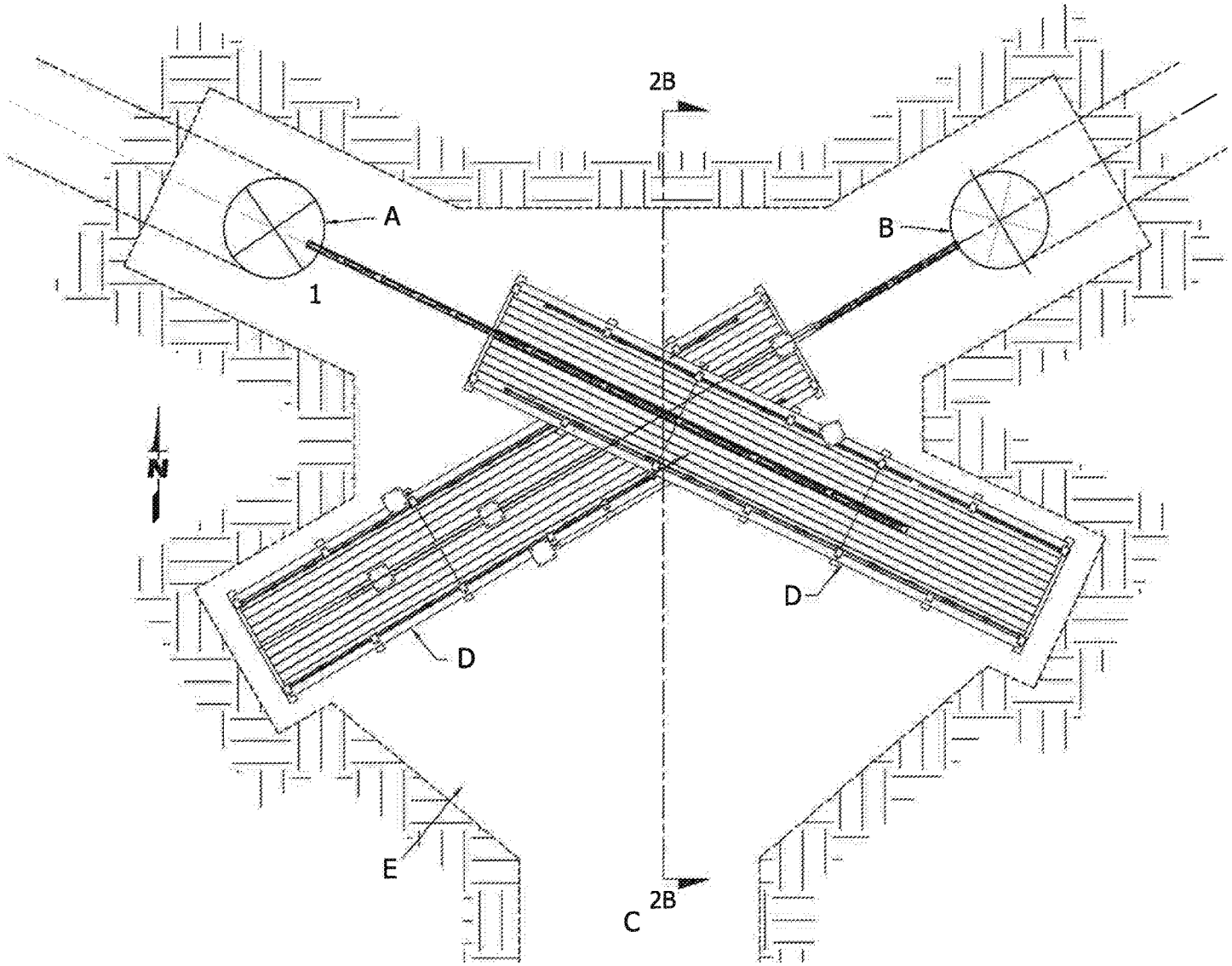
FIG. 2A is a plan view of a conventional system for excavating the planned raises of FIG. 1.
Figure 2B:
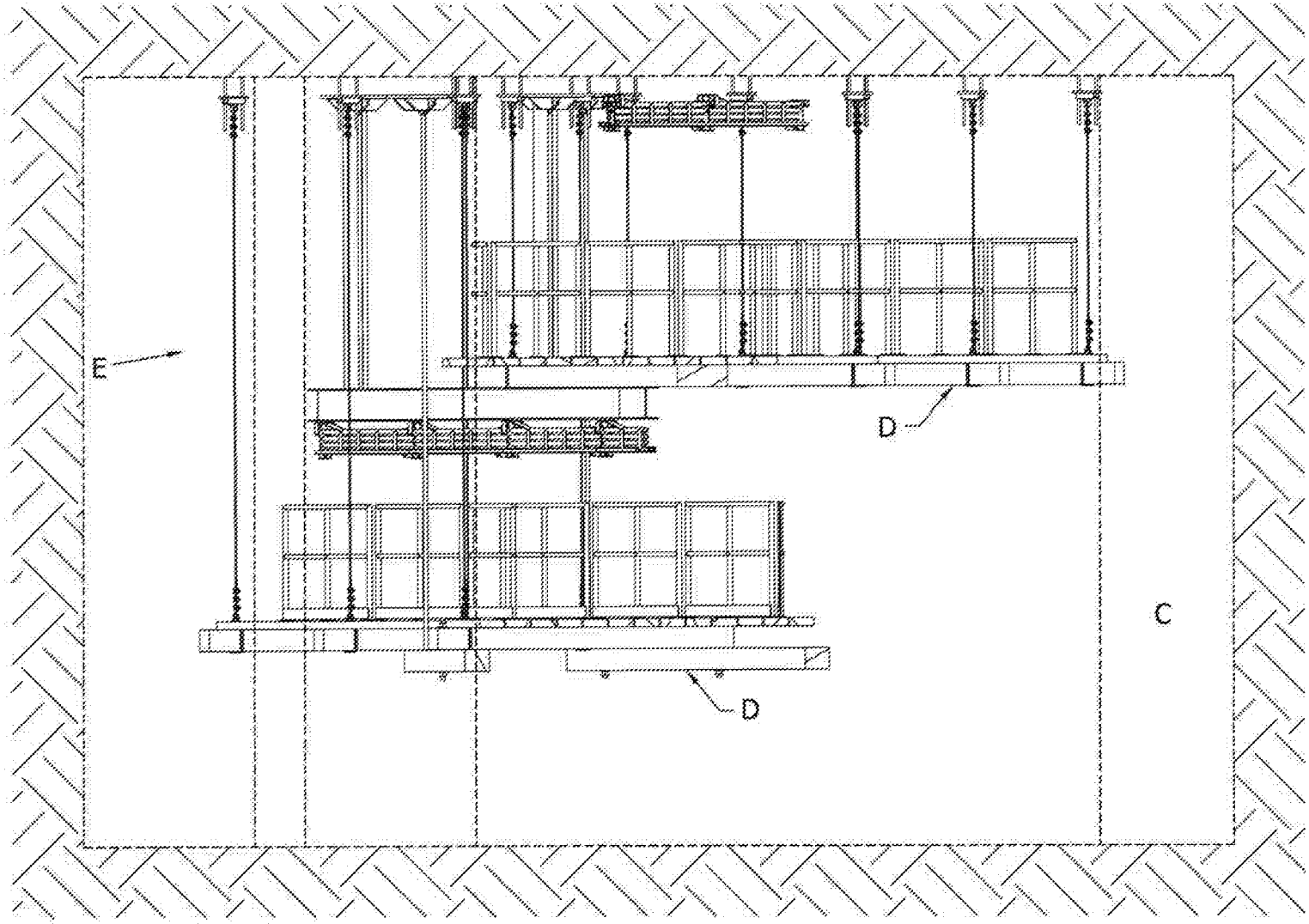
FIG. 2B is a view along section 2B-2B of FIG. 2A.
Figure 3A:
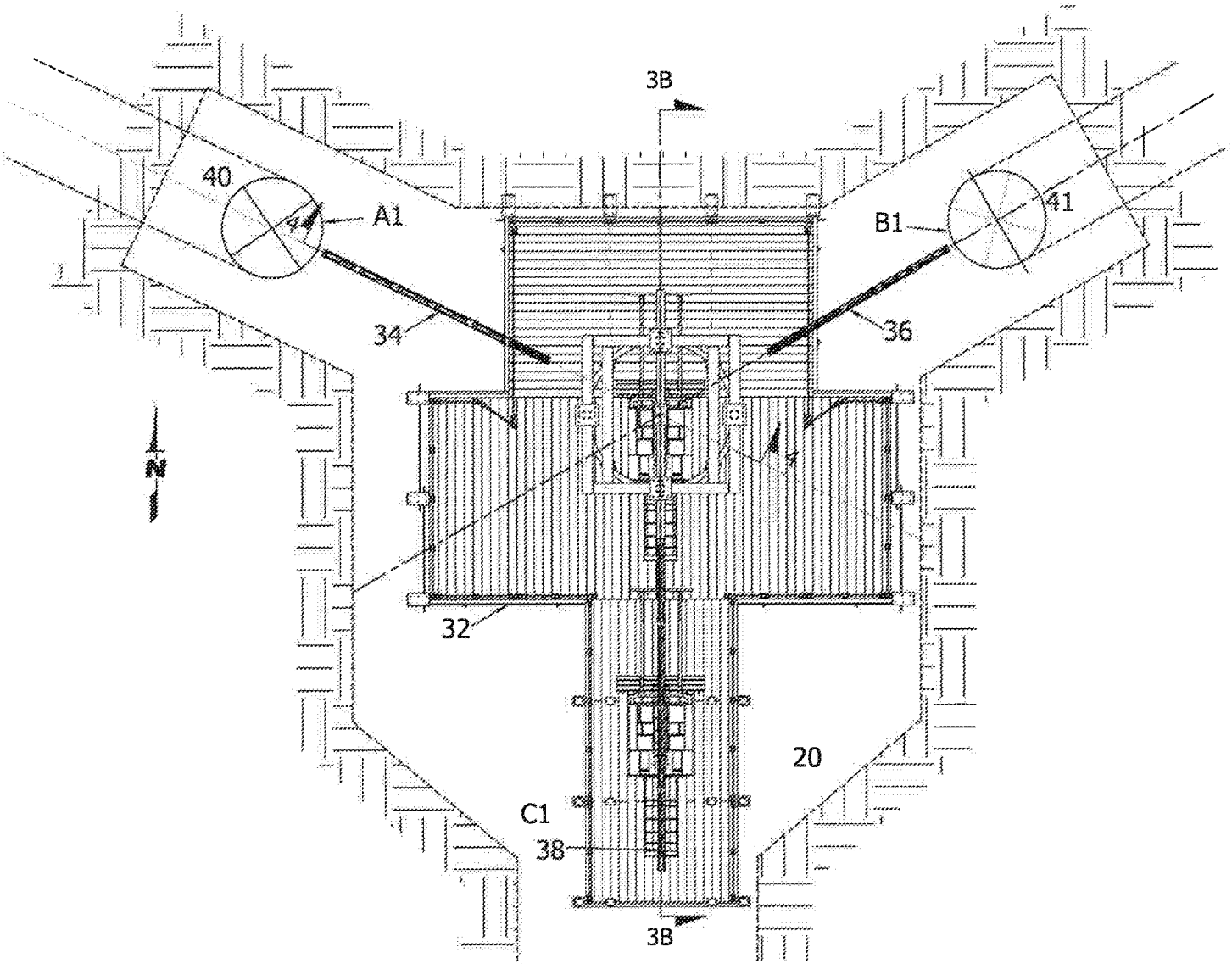
FIG. 3A is a plan view of a system according to an embodiment of the invention for excavating the planned raises of FIG. 1.
Figure 3B:
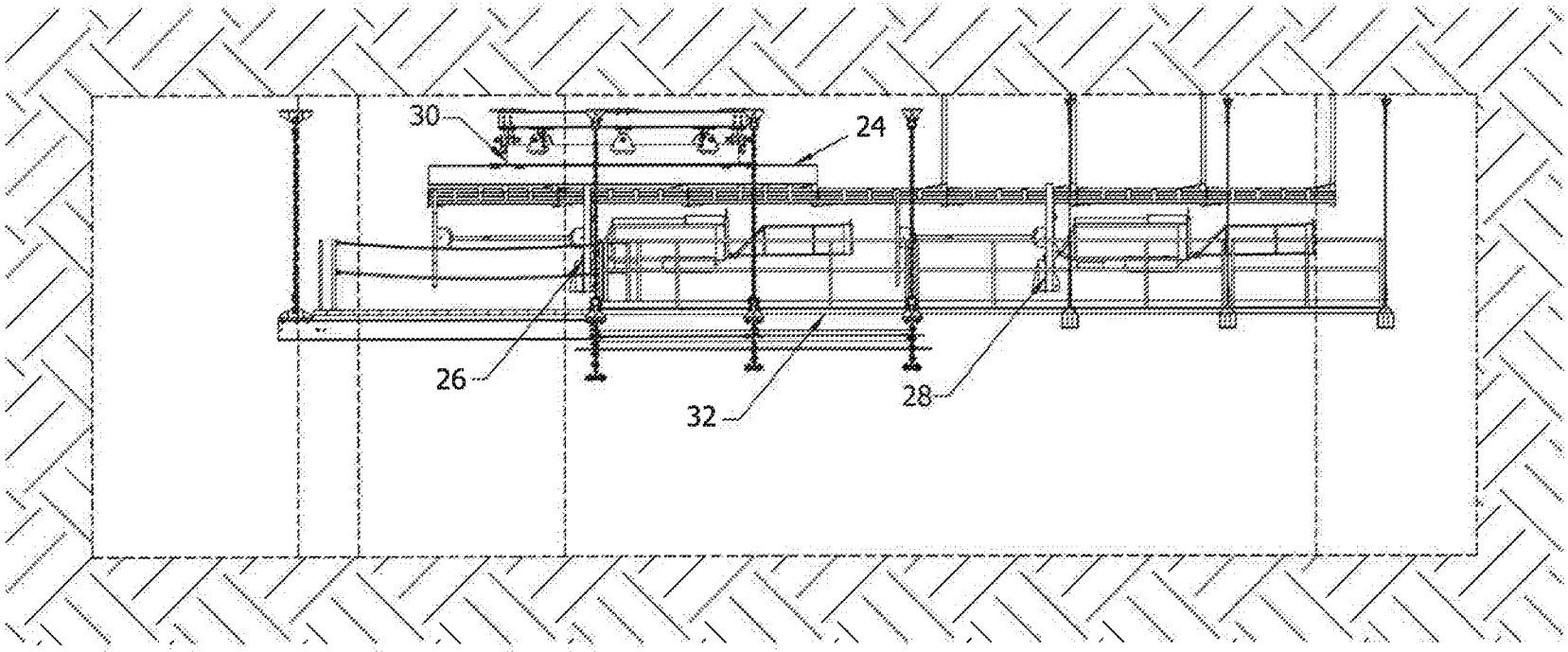
FIG. 3B is a view along section 3B-3B of FIG. 3A.
Figure 4:
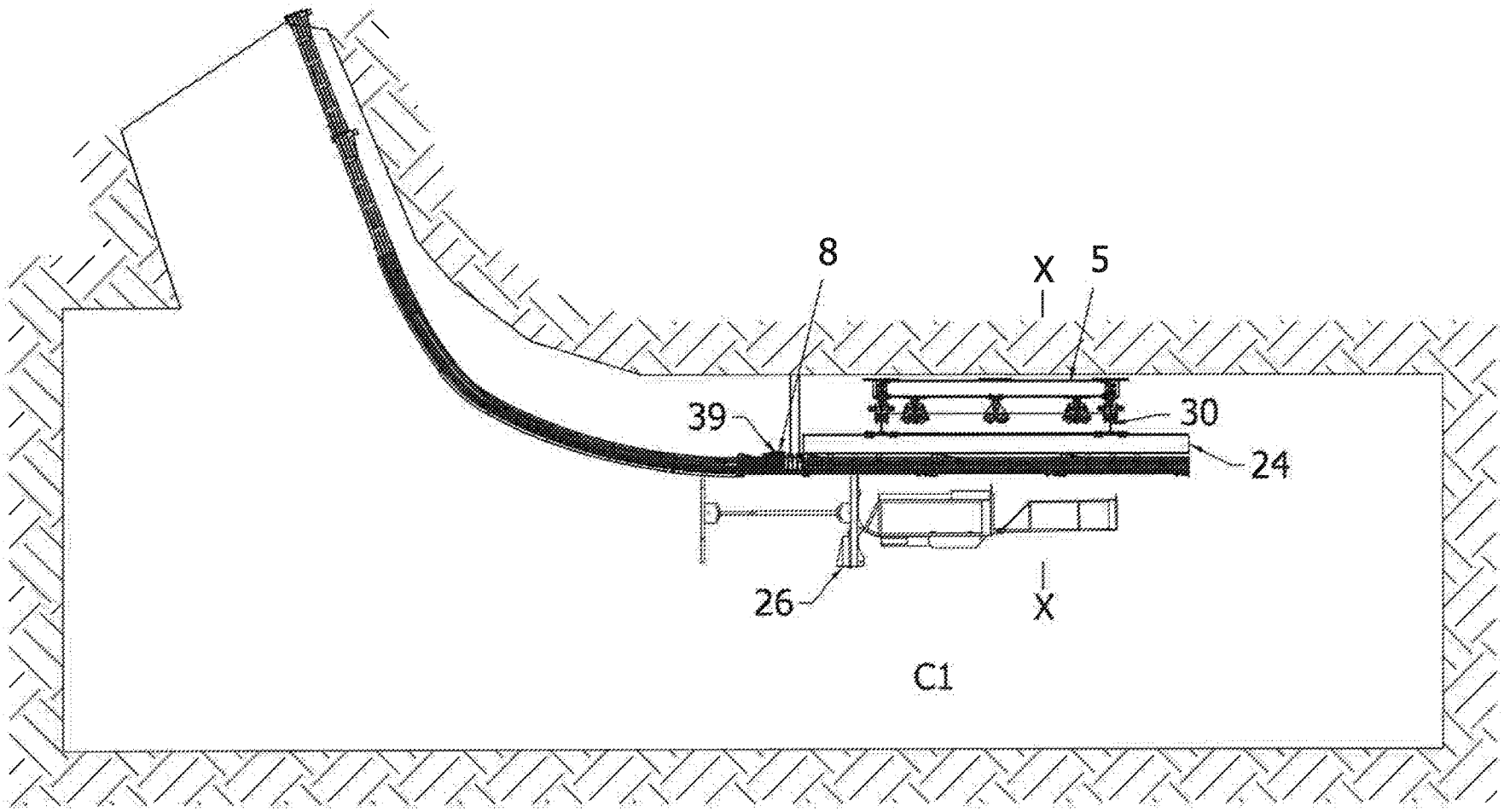
FIG. 4 is a view along section 4-4 of FIG. 3A.
Figure 5:
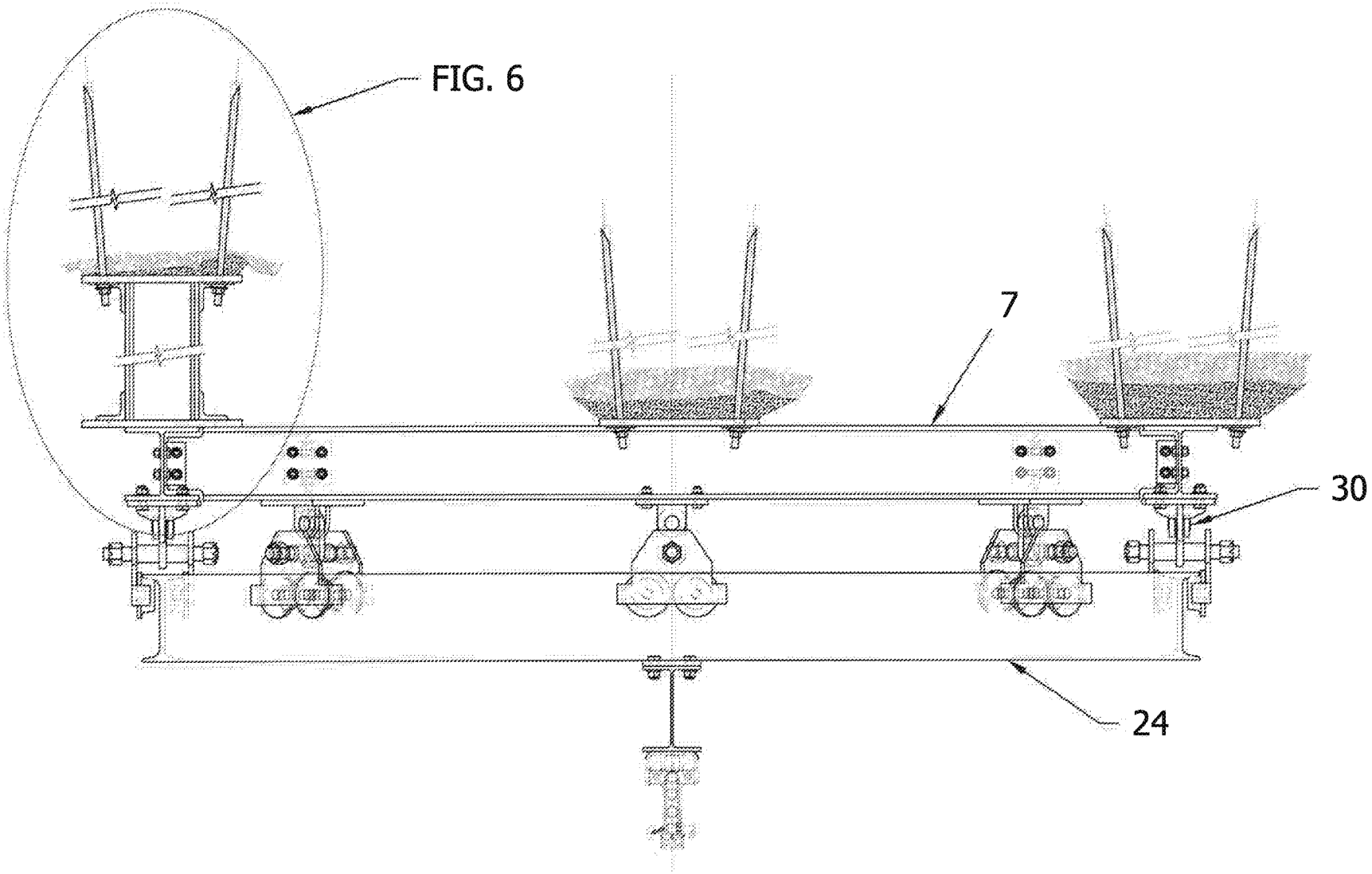
FIG. 5 is an enlarged view of the portion of FIG. 4 identified by arrow 5.
Figure 6:
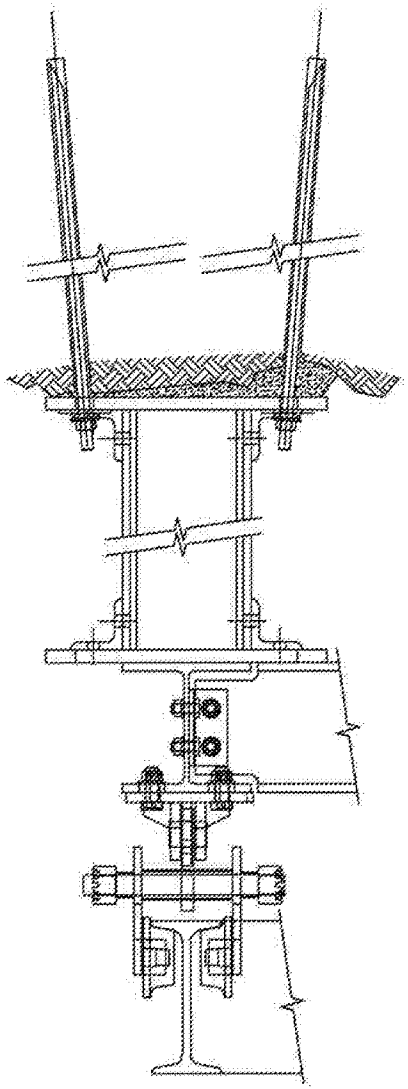
FIG. 6 is an enlarged view of encircled area 6 of FIG. 5.
Figure 7:
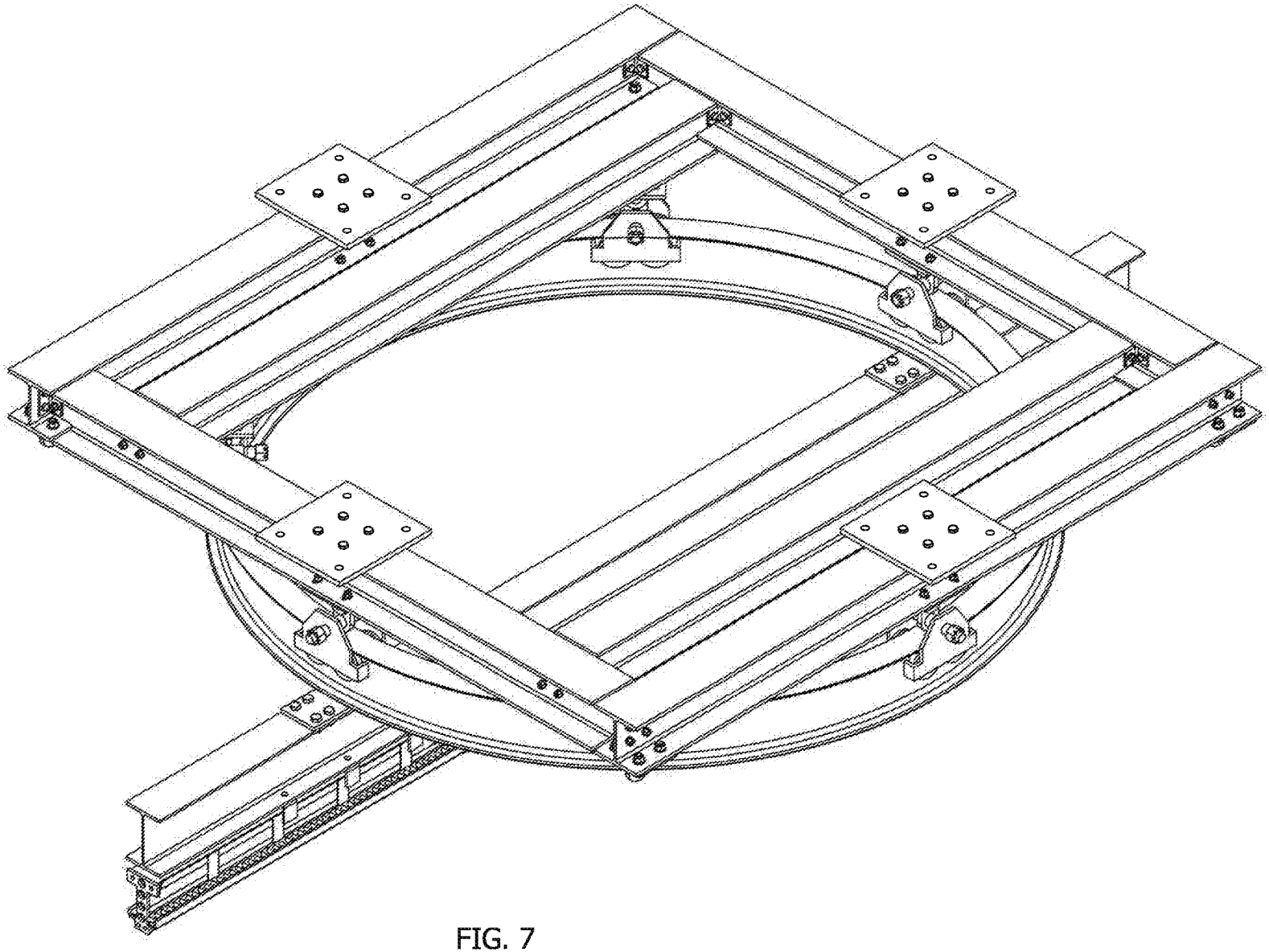
FIG. 7 is an isometric view of the portion of the structure of FIG. 5 identified by arrow 7.

A construct 20 according to an embodiment of the invention is shown in FIGS. 3A-10 and will be seen to comprise: an access drift C', a length of rail 24, a pair of raise climbers 26, 28, a turntable 30, a nest 32, a plurality of rails 34, 36, 38.

The access drift C' is substantially horizontal.

The length of rail 24 is disposed at least partially in the access drift C'.

Each raise climber 26, 28 is a double drive raise climber adapted to be supported by the rail 24 for rolling movement.

The turntable 30 is anchored to the back of the access drift C', has the rail 24 mounted thereto and is adapted to support the rail, and any one of the raise climbers supported thereby, for movement about an axis X-X.

The nest 32 is disposed adjacent the turntable 30.

The rails of the plurality of rails 34, 36, 38 each extend from the turntable 30 such that, when turntable 30 is operatively positioned, the rail 24 of the turntable 30 is aligned therewith, the plurality including at least a pair of curve rails 34, 36 and a nest rail 38.

The pair of curve rails 34, 36 are adapted to develop two raises A', B' at different azimuths collaring from the same heading, at the same elevation and at an acute horizontal angle to access drift C', the two raises consisting of a first raise A' and a second raise B'. In this regard, it will be understood that "develop" means that the rail will be, inter alia, used by a raise climber in the excavation of a raise.

Figure 8:
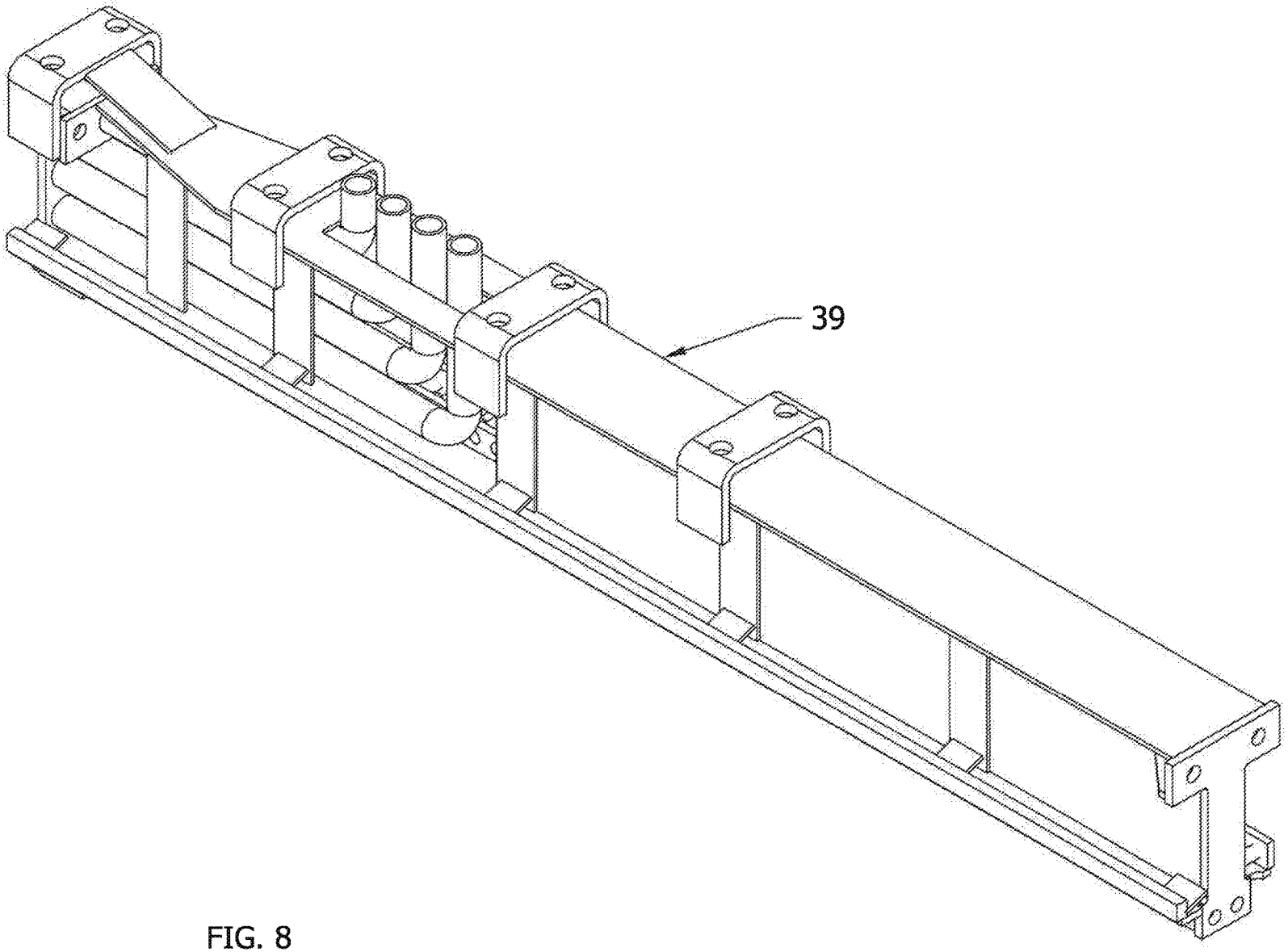
FIG. 8 is an isometric view of the portion of FIG. 4 indicated by arrow 8.

The curve rails 34, 36 will be understood to be defined substantially by convention raise climber rails, but for bridging structures 39, shown in more detail in FIG. 8, adapted to support the weight of the raise climbers as they transition to and from rail 24.

The nest rail 38 is positioned in the nest 32.

Figure 9:
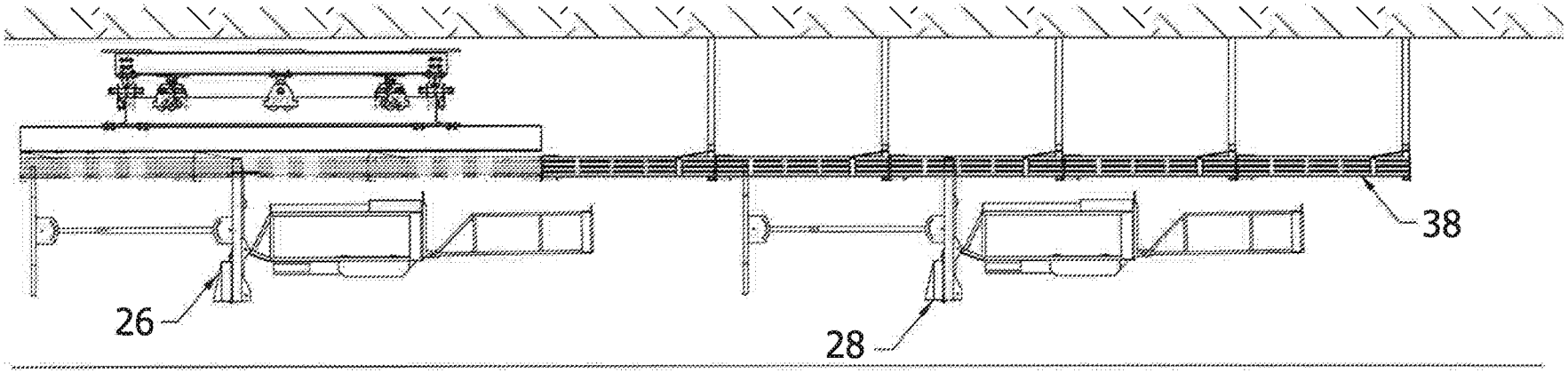
FIG. 9 is a view of a portion of the structure of FIG. 4.

In use, one 26 of the pair of raise climbers is located on the rail 24 supported by the turntable 30 and the other 28 of the pair is located further back in the nest, on the nest rail 38, as indicated by FIG. 9

Figure 10:
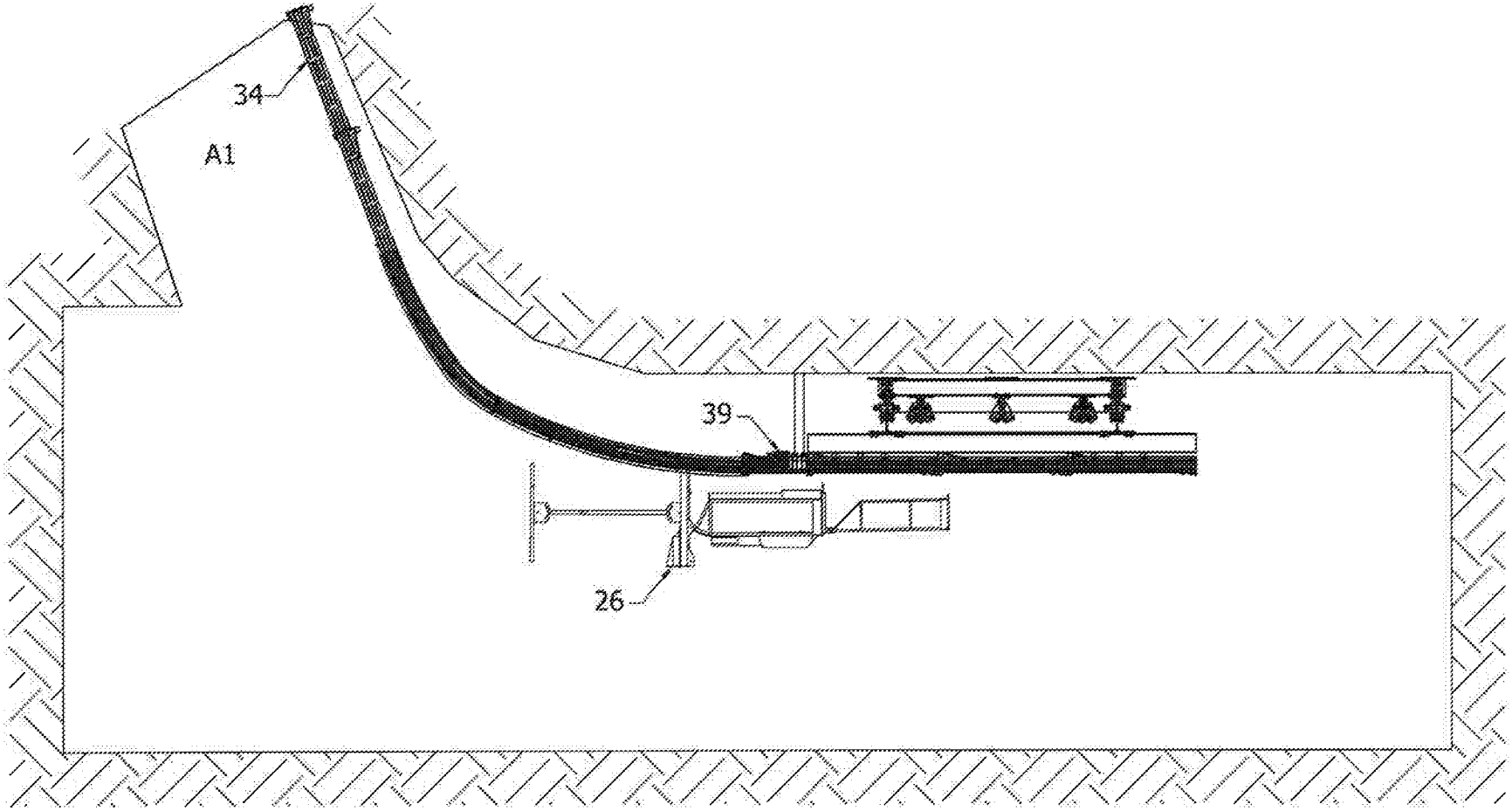
FIG. 10 is a view similar to FIG. 4 showing a raise climber traversing a curve rail.

The turntable 30 is rotated to match with the curve rail 34 leading into the first raise A'. Thereafter, the one 26 of the raise climbers moves from the turntable 30 onto the curve rail 34 and proceeds up the first raise A', as shown in FIG. 10. Thereafter, the turntable 30 rotates to align with the nest rail 38 and the other 28 of the pair of raise climbers moves onto the turntable 30. The turntable 30 then rotates to align with the curve rail 36 leading to the second raise B' and proceeds up second raise B'.

The reverse process is employed to retrieve the raise climbers from the raises.

Persons of ordinary skill will readily appreciate that the foregoing has substantial advantage over other options, including but not limited to:

standard setup and procedures are utilized without physically or procedurally overlapping;

relatively low excavation requirements;

a single nest with centralized services; and a single mucking horizon.

Whereas a specific embodiment is herein shown and described, variations are possible. Accordingly, the invention should be understood to be limited only by the accompanying claims, purposively construed.

The invention claimed is:

1. A construct comprising:

an access drift;

a length of rail disposed in the access drift;

a pair of raise climbers, each adapted to be supported by the rail;

a turntable to which the rail is mounted, the turntable being adapted to support the rail, and a raise climber supported thereby, for movement about an axis;

a nest disposed adjacent the turntable; and a plurality of rails, each extending from the turntable such that, when the turntable is operatively positioned, the rail of the turntable is aligned therewith, the plurality including at least a pair of curve rails and a nest rail, the curve rails each being adapted to develop a raise and the nest rail being positioned in the nest.

2. The construct of claim 1, wherein the pair of curve rails are adapted to develop two raises at different azimuths collaring from the same heading.

3. The construct of claim 1, wherein the pair of curve rails are adapted to develop two raises at different azimuths collaring from the same heading, at the same elevation and at an acute horizontal angle to the access drift.

4. The construct of claim 1, wherein each raise climber is a double drive raise climber.

5. An apparatus for use with a raise climber and in a construct having an access drift, the apparatus comprising:

a rail adapted to support the raise climber; and a turntable adapted to support the rail and the raise climber for movement about an axis.

* * * * *